United States Patent [19]

Parrott

[11] Patent Number: 4,621,869

[45] Date of Patent: Nov. 11, 1986

[54] ROTARY CUTTING HEAD

[75] Inventor: George A. Parrott, Wakefield, England

[73] Assignee: Minnovation Limited, Wakefield, England

[21] Appl. No.: 708,976

[22] Filed: Mar. 7, 1985

[51] Int. Cl.[4] ..... E21C 35/22

[52] U.S. Cl. ..... 299/81; 137/624.13

[58] Field of Search ..... 299/17, 81; 137/624.13, 137/624.15

[56] References Cited

U.S. PATENT DOCUMENTS

| | | | |
|---|---|---|---|
| 4,049,318 | 9/1977 | Fruin | 299/81 |
| 4,212,497 | 7/1980 | Borowski et al. | 299/81 |
| 4,368,925 | 1/1983 | Honke | 299/81 |
| 4,470,636 | 9/1984 | Paurat et al. | 299/81 |

FOREIGN PATENT DOCUMENTS

| | | | |
|---|---|---|---|
| 2106962 | 4/1983 | United Kingdom . | |
| 2072238 | 10/1983 | United Kingdom . | |
| 284933 | 3/1971 | U.S.S.R. | 299/81 |
| 481698 | 7/1976 | U.S.S.R. | 299/81 |

*Primary Examiner*—James A. Leppink
*Assistant Examiner*—William P. Neuder
*Attorney, Agent, or Firm*—Trexler, Bushnell & Wolters

[57] ABSTRACT

A rotary mineral winning/rock cutting head 1 comprises a plurality of water discharge nozzles 8, at least one supply conduit 23, 24, 25, 26, 28, 30, 35, 36, 37 to convey, in use, pressurized water to the discharge nozzles 8 from a supply source, and valve means 38 associated with the or each conduit 23, 24 to permit or prevent a flow of water along the conduit(s) 23, 24, to achieve phased water control with water discharge from the nozzles 8 located in, or adjacent, the cut segment in the course of rotation of the head 1, and no discharge from the nozzles 8 located in, or adjacent, the non-cut segment, each valve means 38 comprising a rotary valve member 43, with an actuator shaft 45 operable on the valve member 43 to rotate the latter through "on" and "off" positions, and at least one arm 50 extending radially from the actuator shaft 45 and adapted, upon rotation of the head 1, to be displaced by contact with, and/or guidance by, an abutment device 53 to cause rotation of the arm 50, and hence both its actuator shaft 45 and rotary valve member 43, through an arc of a circle, so as to displace the valve member 43 from an "on" position to an "off" position, or from an "off" position to an "on" position.

16 Claims, 3 Drawing Figures

ROTARY CUTTING HEAD

This invention relates to a pick armed, rotary cutting head, either for mineral winning operations e.g. of the general kind that is used extensively for coal mining, on what is known as a shearer type mining machine, or alternatively for rock cutting, of the general kind used extensively for underground roadway or tunnel driving, on what is known as a roadheader type machine.

It is necessary to supply pressurised water to the head, for various functions. One function is for pre-start warning purposes, where water is supplied to spray nozzles to emit a spray of water for a prescribed period e.g. 7 seconds, before machine start up is allowed to occur. Another function is known as pick face flushing (p.f.f), which also has an ancilliary dust suppressing effect. As possibly 50 spray nozzles are provided on a head, considerable quantities of water are required, but in reality only a minor proportion e.g. one third, of the nozzles are in the cut, or in close proximity to the cut, with the result that some two thirds of the nozzles are emitting sprays away from the cut. Furthermore, more recently there have been proposals to enhance the mineral winning/rock cutting effect resulting from cutter picks by employing in addition high pressure jets of water.

Thus, for pre-start warning, p.f.f. or water jet cutting, considerable savings can be effected the in water gallonage used, (which water necessarily must be filtered, to avoid contaminants blocking the nozzles, as well as pressurised), if the water supply is phased so that, only the jet nozzles which are actually in the cut, are supplied with pressurised water, and this is virtually essential where water jet cutting is involved otherwise some nozzles would disadvantageously attack the mine roof and others would attack the mine floor, apart from adding to water dispersal/wet mineral handling problems, and many proposals have been advanced for achieving satisfactory phasing. However, prior art phasing proposals (e.g., GB No. 2072238 and GB No. 2106962) have been relatively complex, resulting not only in relatively high manufacturing costs, but also in relatively high maintenance costs.

According to the present invention, there is provided a rotary, mineral winning/rock cutting head comprising a plurality of water discharge nozzles, at least one supply conduit to convey, in use, pressurised water to the discharge nozzles from a supply source, and valve means associated with the or each conduit to permit or prevent a flow of water along the conduit(s), to achieve phased water control with water discharge from the nozzles located in, or adjacent, the cut segment in the course of rotation of the head, and no discharge from the nozzles located in, or adjacent, the non-cut segment, each valve means comprising a rotary valve member, with an actuator shaft operable on the valve member to rotate the latter through "on" and "off" positions, and at least one arm extending radially from the actuator shaft and adapted, upon rotation of the head, to be displaced by contact with, and/or guidance by, an abutment device to cause rotation of the arm, and hence both its actuator shaft and rotary valve member, through an arc of a circle, so as to displace the valve member from an "on" position to an "off" position, or from an "off" position to an "on" position.

Thus, the rotary cutting head in accordance with the invention provides an extremely simple means of controlling phased water admission to, or passage along, its conduit and hence to its associated discharge nozzle(s), with the valve member simply being rotated upon an arm rotation.

For a p.f.f. supply, the nozzles are spray nozzles and, the abutment device may be so arranged that phased water supply is only available to the nozzles in, or adjacent, the cut segment e.g. over approximately 120° of the drum circumference, so that the largely superfluous water discharge from nozzles located over the remaining 240° of the drum circumference is eliminated. For a drum where in addition to a p.f.f. supply, a higher pressure water supply is also required for water jet cutting purposes, a series of jet nozzles are required, with their own supply conduit(s) having a rotary valve member, again with the abutment device arranged to cause water supply over a segment subtending say 90° to 180° or more, as may be required for the particular operating conditions.

For either arrangement, a steady water supply may be made provided over the cut segment by having an abutment device rotate each rotary valve member to its "on" position at the start of the cut segment and to its "off" position at the end of the cut segment, but particularly for water jet cutting, a pulsating supply may be more desirable than a steady supply and may be provided over the cut segment by having an abutment device rotate each rotary valve member to its "on" position at the start of the cut, and then repeatedly through its "off" and "on" conditions as many times as is possible or desirable upon passage of the nozzle through the cut segment until the final "off" rotation at the end of the cut segment.

Preferably, for either p.f.f. or water jet cutting, a single valve member controls water flow to a plurality of nozzles.

In detail, for a mineral winning rotary cutting head, the valve means may be located in a face side distributor plate located adjacent the mineral face, with the actuator shafts extending rearwardly, parallel to the axis of rotation of the head, with ends of the actuator shafts remote from the valve means emerging at the goaf side end of the head, where the arm(s) is located.

The abutment device may, in a first embodiment, take the form of a plurality of circumferentially spaced pegs located for example around a hub on which the rotary head is mounted and projecting axially into the path of the arm(s). Alternatively, the pegs may be spaced around the periphery of a rotatable support collar of a conventional, powered cowl.

Thus, the segment over which supply is required may be defined by an "on" peg and an "off" peg. To achieve a pulsating supply any number of "off" and "on" pegs may be alternated in the space available, between the initial "on" peg and the final "off" peg.

In detail, with the multi-armed embodiment of actuator shaft, four arms may be provided, spaced 90° apart, on a star wheel.

In a second embodiment, the abutment device may be constituted by a cam track, e.g. provided in, and/or around, an end face of a mounting hub or cowl support collar, into which cam track projects a trailing control arm of an actuator shaft, the control arm being angularly displaced about the axis of the actuator shaft, and hence the rotary valve member being correspondingly rotated, upon following the prescribed path of the cam track. To achieve a pulsating supply, the cam track may be generally sinusoidal, so as to be capable of oscillating the trailing control arm sufficiently e.g. through approximately 90°, to achieve rotation of the valve member repeatedly through its "off" and "on" positions.

Each valve means may comprise a static, outer valve part located in the distributor plate, with a through bore extending in the longitudinal direction of its associated conduit, with a transverse bore intersecting the through bore and rotatably receiving the rotary valve member, the latter having a diametral bore capable of being aligned with the through bore to put the valve means in the "on" position, and rotatable through approximately 90° to the "off" position, and through a further 90° to the "on" position, with the valve member in driving relationship with the adjacent end of its actuator shaft.

The invention will now be described in greater detail, by way of examples, with reference to the accompanying diagrammatic drawings, in which.

Figure 1:
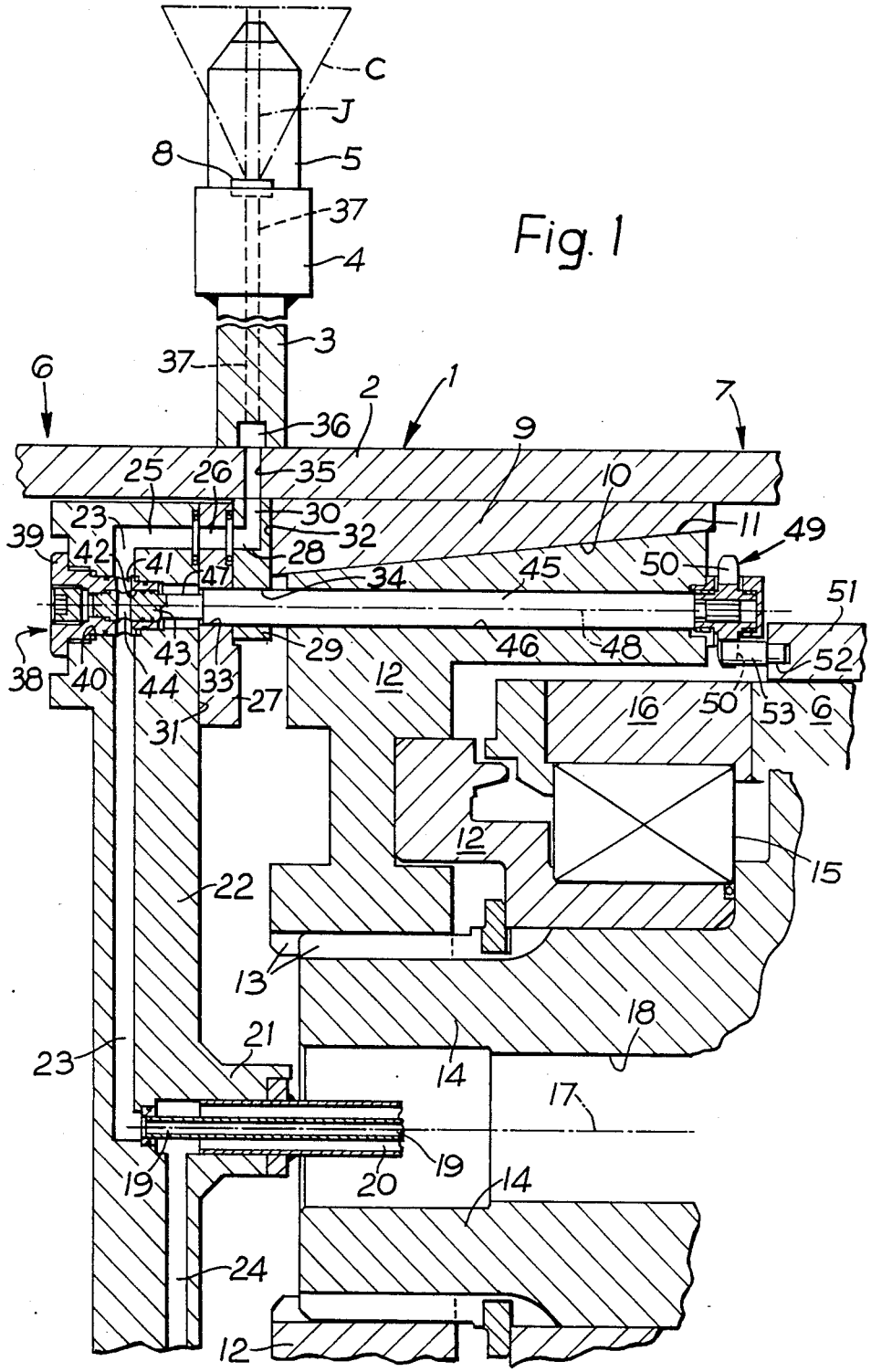
FIG. 1 is an axial sectional view through a portion of a first embodiment of pick armed, rotary, mineral winning head in accordance with the invention.

In the drawings, a rotary, mineral winning head is indicated generally at 1 and comprises an outer barrel point 2 around the external periphery of which is secured, e.g., by welding, at least one helical vane 3 provided, in the conventional manner, with a plurality of pick boxes 4 each to retain releasably a replaceable cutter pick 5. The head 1 has a face-side end 6 intended, in use, to be located adjacent a mineral face, and a goaf-side end 7 intended, in use, to be located adjacent the goaf area or the associated mining machine (not shown). In the vicinity of each pick box 4, the vane 3 is also provided with a water spray nozzle 8 connected to a supply of pressurised water, as will be described in greater detail later.

Around the internal periphery of the outer barrel part 2 is provided a mounting ring 9 having a frusto-conical mounting surface 10 for engagement with a similar mounting surface 11 of a mounting hub 12 which makes a splined attachment at 13 with a shaft 14 supported by bearings 15 at one end of a ranging arm 16 which is pivotally attached at its other end to the associated mining machine which is provided with a power source (usually an electric motor) and a transmission from the power source to the head 1. Thus, the shaft 14, hub 12 and head 1 are all rotatable about a common axis 17, the shaft 14 having a through bore 18 for the passage of ancilliary equipment, in the form of co-axial first and second water supply tubes 19, 20, each containing water at different pressure for a different purpose e.g., one tube may supply low pressure water for pick face flushing and pre-start warning, while the other tube may supply high pressure water for water jet assisted cutting. The tubes 19 and 20 terminate in a hub 21 of a face side distributor plate 22 carried by the mounting ring 9. The distributor plate 22 is provided with a first set of radially extending supply conduits 23 associated with the tube 19, and a second set of radially extending supply conduits 24 associated with the tube 20. Each radial tube 19 is intersected by an axial tube 25 in communication with a bore 26 in a first annular plate 27, with water sealing washers appropriately located. The bore 26 is, in turn, in communication with an axial bore 28 in a second annular plate 29 and the axial bore 28 is in communication with a radial bore 30. The plates 27 and 29 are sandwiched between a radially outer, annular part 31 of the distributor plate 27 and an end 32 of the mounting ring 9, each being provided with a circular through hole 33, 34. The radial bore 30 is in communication with a radial bore 35 in the outer barrel part 2, the bore 35 being in communication with a circumferential conduit 36 extending around the base of the vane 3, the conduit 36 being intersected at various locations by radially extending conduits 37 leading to a nozzle 8, or to a plurality of such nozzles.

Valve means 38 is associated with each conduit 23, 24, each valve means 38 comprising a static, outer valve part 39 retained in a suitably drilled, axially extending, aperture 40 in the distributor plate 22. Again, water seals are provided at appropriate locations. The static valve part 39 has a through bore 41 extending in the longitudinal direction of its associated conduit 23, and also has a transverse bore 42 intersecting the through bore 41 and serving to house a rotary valve member 43 having a diametral bore 44 capable of being aligned with the through bore 41, in a valve "on" condition, and non-aligned in a valve "off" condition. The rotary member 43 is rotatable through its "on" and "off" conditions by a circular section actuator shaft 45 passing through the axially aligned holes 33, 34 in the annular plates 27, 29 and an axially aligned hole 46 in the hub 12. The actuator shaft 45 makes driving engagement with the rotary valve member 43 via a dog arrangement provided on a reduced diameter end portion 47 and has an axis of rotation 48 parallel to the axis 17. At the goaf side end 7, the actuator shafts 45 emerge and are each drivable by an individual star wheel 49 comprising four arms 50, spaced 90° apart, each arm extending radially from its actuator shaft 45. Around the ranging arm 16 is a hub/cowl support collar 51 in an end face of which are provided a plurality of tapped holes 52 into each, or selected ones, of which is screwed an abutment device in the form of a peg 53 projecting axially into the path of one of the arms 50 of each star wheel 49 so that the latter upon an arm thereof striking a peg 53, upon rotation of the head 1, is rotated through approximately 90°, thus rotating the actuator shaft 45 and rotary valve member 43 through this same angle. Although not illustrated, the conduits 24 are connected in just the same manner to other water discharge nozzles.

It follows that to ensure water emission only from nozzles 8 that are in the cut, an "on" peg 53 must be provided at the start of the cut segment (or conversely at the end of the non-cut segment), and an "off" peg 53 must be provided at the end of the cut segment (or conversely at the start of the non-cut segment). The above arrangement will provide a steady water supply to the nozzles 8 over the time period from when the nozzles enter the cut segment until they leave the cut segment, such supply being suitable for prestart warning and for pick-face flushing, the nozzles 8 producing for example a conical spray C illustrated in chain dotted line in FIG. 1. However, for water jet assisted cutting, where the nozzles 8 would produce a coherent water jet J illustrated in chain dotted line in FIG. 1, a pulsating water supply, in contrast to a steady supply, is desirable, and this may readily be achieved by providing a plurality of alternating "off" and "on" pegs 53, over the sector defined between the first "on" peg and the last "off" peg.

Figure 2:
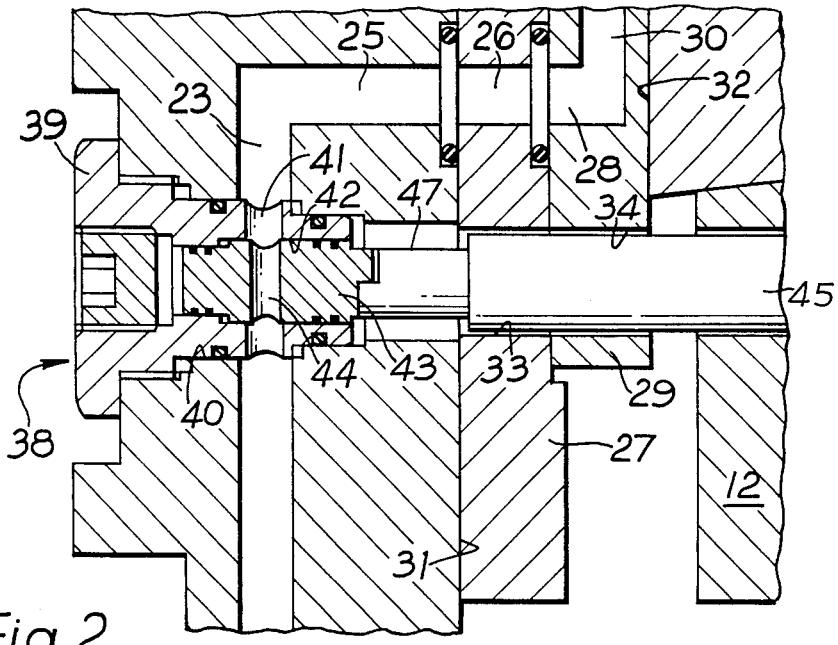
FIG. 2 is an enlarged view of the valve means area of FIG. 1.
Figure 3:
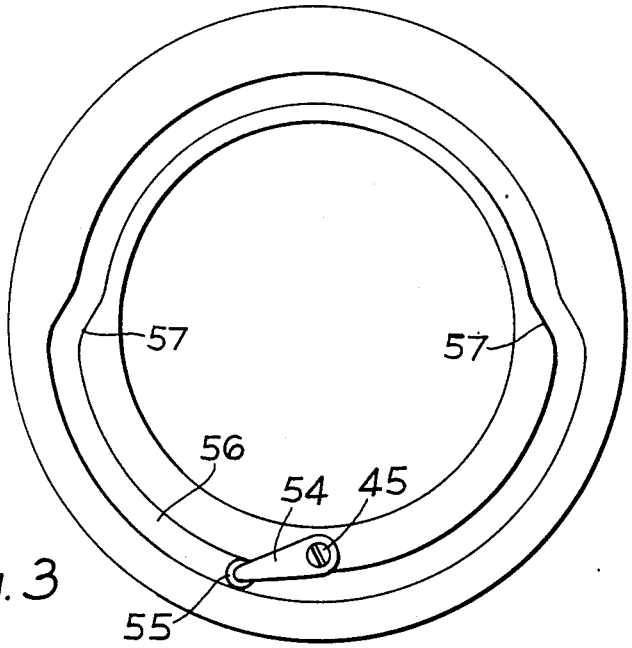
FIG. 3 is an end view on a portion of a second embodiment of head in accordance with the invention.

In the embodiment of FIG. 2 is shown an alternative arrangement to the star wheel 49 and pegs 53 of FIG. 1, in that each actuator shaft 45 is provided with a trailing, control arm 54 provided with a follower 55 located in a cam track 56 cut into the end face of the hub/cowl support collar 51. The cam track 56 is provided with a peak or depression at locations 57 where a change of state of the associated valve means 38 is required. If pulsating, in contrast to steady state, water supply is required, then the track 56 is made generally sinusoidal between its "on" location 57 and its "off" location 57.

The water supply tubes 19 and 20 are connected to remotely located sources of pressurised water e.g. water pumps on board the associated mining machine.

What I claim is:

1. A mineral winning/rock cutting assembly, comprising a ranging arm and a cutting head rotatably supported on said ranging arm, said cutting head comprising a plurality of water discharge nozzles, at least one water supply conduit to convey, in use, pressurized water to said discharge nozzles, and valve means associated with said at least one conduit to permit or prevent a flow of water along said at least one conduit, to achieve phased water control, with water discharge from said nozzles when located in, or adjacent, a segment of cut in the course of rotation of said head, and no discharge from said nozzles when located in, or adjacent, a non-cut segment, each of said valve means comprising a rotary valve member, with an actuator shaft operable on said valve member to rotate the latter through "on" and "off" positions, and at least one arm extending radially from said actuator shaft and an abutment device supported on said ranging arm and being non-rotatable with respect to said rotary cutting head but rotatably adjustable with respect to said rotary cutting head to provide water phasing adjustments, said abutment device being adapted, upon rotation of said head with respect to said abutment device, to cause rotation of said actuator shaft via said at least one arm thereof, and hence to cause rotation of said at least one rotary valve member, through an arc of a circle, so as to displace said at least one valve member between an "on" and an "off" position.

2. An assembly as claimed in claim 1, wherein said abutment device causes rotation of said actuator shaft(s) by contact with said arm(s).

3. An assembly as claimed in claim 1, wherein said abutment device causes rotation of said actuator shaft(s) by guidance of said arm(s).

4. An assembly as claimed in claim 1, wherein the nozzles are spray nozzles.

5. An assembly as claimed in claim 1, wherein a steady water supply is provided over said cut segment by having said abutment device rotate each of said rotary valve member(s) to its "on" position at the start of said cut segment and to its "off" position at the end of said cut segment.

6. An assembly as claimed in claim 1, wherein a pulsating water supply is provided over said cut segment by having said abutment device rotate each of said rotary valve members to its "on" position at the start of said cut segment, and then repeatedly through its "off" and "on" conditions as many times as is possible or desirable upon passage of said valve member through said cut segment until a final "off" rotation at the end of said cut segment.

7. An assembly as claimed in claim 1, comprising a face side distributor plate located, in use of the head, adjacent the mineral face, said valve means being located in said distributor plate with said actuator shafts extending rearwardly, parallel to the axis of rotation of said head, with ends of said actuator shafts remote from said valve means emerging at a goaf side end of said head, at which end said arm(s) is located.

8. An assembly as claimed in claim 1, wherein said abutment device takes the form of a plurality of circumferentially spaced pegs projecting axially into the rotational path of said arm(s).

9. An assembly as claimed in claim 8, comprising a hub/cowl support collar on which the head is mounted, with said pegs located around said collar.

10. An assembly as claimed in claim 1, wherein a star wheel is provided on each of said actuator shafts said star wheel being provided with four arms, spaced 90° apart.

11. An assembly as claimed in claim 1, wherein said abutment device is constituted by a cam track.

12. An assembly as claimed in claim 11, wherein said cam track is provided in, and/or around, an endface of a mounting hub or cowl support collar.

13. An assembly as claimed in claim 11, wherein said control arm is angularly guided about the axis of rotation of said actuator shaft, upon following the prescribed path of the cam track.

14. An assembly as claimed in claim 1, comprising a distributor plate at a face side of said head of said valve means comprises a static, outer valve part located in said distributor plate, with a through bore extending through said outer valve part in the longitudinal direction of its associated conduit, and with a transverse bore intersecting said through bore, said transverse bore rotatably receiving said rotary valve member, a diametral bore provided in said rotary valve member and capable of being aligned with said through bore and hence with said conduit in the "on" position, and rotatable through approximately 90° to the "off" position, and through a further 90° to the "on" position, with said valve member in driving relationship with an adjacent end of its actuator shaft.

15. A rotary mineral winning/rock cutting assembly comprising; a cutting head of the type for mounting to a ranging arm of a mineral winning machine, wherein said cutting head is rotatable relative to said ranging arm; and an abutment arrangement fixedly mounted on said ranging arm, said cutting head comprising, a plurality of water discharge nozzles; at least one water supply conduit to convey, in use, pressurized water to said discharge nozzles, valve means associated with said conduit to permit or prevent a flow of water along said conduit, to achieve phased water control, with water to be discharged from said nozzles when located in, or adjacent, a rock segment to be cut in the course of rotation of said cutting head, and no discharge from said nozzles when located in, or adjacent, a non-cut segment, each of said valve means comprising a rotary valve member, with an actuator shaft operable on said valve member to rotate the latter through "on" and "off" positions, at least one arm extending radially from said actuator shaft; said abutment arrangement engaging said at least one arm upon relative rotation of the cutting head to produce rotation of said actuator shaft and hence to produce rotation of said at least one rotary valve member to operate said at least one valve member between an "on" or an "off" position and thereby achieve phasing of the supply of water to the discharge nozzles of said cutting head.

16. A cutting head assembly according to claim 15, wherein said abutment arrangement is adjustable with respect to its position on said ranging arm, thereby providing for rotatable adjustment of the position of the abutment arrangement relative to said rotatable cutting head.

* * * * *